US010419849B2

(12) United States Patent
Franck et al.

(10) Patent No.: US 10,419,849 B2
(45) Date of Patent: Sep. 17, 2019

(54) FIR FILTER COEFFICIENT CALCULATION FOR BEAM-FORMING FILTERS

(71) Applicant: Fraunhofer-Gesellschaft zur Foerderung der angewandten Forschung e.V., Munich (DE)

(72) Inventors: Andreas Franck, Southampton (GB); Christoph Sladeczek, Ilmenau (DE); Albert Zhykhar, Ilmenau (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

(21) Appl. No.: 15/435,744

(22) Filed: Feb. 17, 2017

(65) Prior Publication Data

US 2017/0164100 A1 Jun. 8, 2017

Related U.S. Application Data

(63) Continuation of application No. PCT/EP2015/069291, filed on Aug. 21, 2015.

(30) Foreign Application Priority Data

Aug. 22, 2014 (EP) ..... 14182043
Feb. 27, 2015 (DE) ..... 10 2015 203 600

(51) Int. Cl.
*H04R 1/40* (2006.01)
*H04R 3/00* (2006.01)
*H04R 3/12* (2006.01)

(52) U.S. Cl.
CPC ..... *H04R 1/403* (2013.01); *H04R 1/406* (2013.01); *H04R 3/005* (2013.01); *H04R 3/12* (2013.01);

(Continued)

(58) Field of Classification Search
CPC combination set(s) only.
See application file for complete search history.

(56) References Cited

U.S. PATENT DOCUMENTS 6,594,367 B1 7/2003 Marash et al.
7,619,563 B2 * 11/2009 Taenzer ..... G01S 7/2813 342/442

(Continued)

FOREIGN PATENT DOCUMENTS

CN 102440002 A 5/2012
CN 103098132 A 5/2013

(Continued)

OTHER PUBLICATIONS

Alkhairy, Ashraf S. et al., "Design and Characterization of Optimal FIR Filters with Arbitrary Phase", IEEE Transactions on Signal Processing, vol. 41, No. 2, Feb. 1993, 14 pages.

(Continued)

*Primary Examiner* — Duc Nguyen
*Assistant Examiner* — Assad Mohammed
(74) *Attorney, Agent, or Firm* — Perkins Coie LLP; Michael A. Glenn

(57) ABSTRACT

The effectiveness of calculating FIR filter coefficients for beam-forming filters for transducer arrays such as arrays of microphones or loudspeakers, for example, is increased in that the calculation is performed in two stages; namely, on the one hand, by calculating frequency domain filter weights of the beam-forming filters, i.e., coefficients describing the transfer functions of the beam-forming filters within the dimension of the frequency so as to obtain target frequency responses for the beam-forming filters, so that applying the beam-forming filters to the array approximates a desired directional selectivity, and followed by calculating the FIR filter coefficients for the beam-forming filters, i.e., of coefficients describing the impulse response of the beam-form- (Continued)

ing filters within the time domain, such that the frequency responses of the FIR beam-forming filters approximate the target frequency responses in an optimum manner in accordance with defined criteria.

14 Claims, 7 Drawing Sheets

(52) U.S. Cl.
CPC ..... *H04R 2201/40* (2013.01); *H04R 2430/20* (2013.01)

(56) References Cited

U.S. PATENT DOCUMENTS

| | | | | |
|---|---|---|---|---|
| 2002/0001389 | A1* | 1/2002 | Amiri | G01S 3/801 381/56 |
| 2004/0223620 | A1 | 11/2004 | Horbach et al. | |
| 2005/0195988 | A1 | 9/2005 | Tashev et al. | |
| 2007/0076898 | A1 | 4/2007 | Sarroukh et al. | |
| 2012/0093344 | A1* | 4/2012 | Sun | H04R 3/005 381/122 |
| 2012/0269368 | A1 | 10/2012 | Horbach | |
| 2013/0142343 | A1* | 6/2013 | Matsui | G10L 21/028 381/56 |
| 2013/0258813 | A1* | 10/2013 | Herre | H04R 1/406 367/135 |
| 2013/0259238 | A1 | 10/2013 | Xiang et al. | |
| 2014/0219471 | A1* | 8/2014 | Deshpande | H04R 3/005 381/92 |
| 2016/0353205 | A1 | 12/2016 | Munch | |

FOREIGN PATENT DOCUMENTS

| | | | |
|---|---|---|---|
| EP | 1538867 | A1 | 6/2005 |
| EP | 1919251 | A1 | 5/2008 |
| JP | 2003514481 | A | 4/2003 |
| JP | 2005253071 | A | 9/2005 |
| JP | 2006033502 | A | 2/2006 |
| JP | 2007523514 | A | 8/2007 |
| JP | 2008104229 | A | 5/2008 |
| KR | 1020150002736 | A | 1/2015 |
| KR | 1020160105898 | A | 9/2016 |
| WO | 2013006323 | A2 | 1/2013 |

OTHER PUBLICATIONS

Bitzer, Joerg et al., "2 Superdirective Microphone Arrays", M. Brandstein et al. (eds.), Microphone Arrays. Springer-Verlag Berlin Heidelberg, 2001, 20 pages.
Hatziantoniou, Panagiotis D. et al., "Generalized Fractional-Octave Smoothing of Audio and Acoustic Responses", Journal of the Audio Engineering Society, vol. 48, No. 4, Apr. 2000, 22 pages.
Karam, Lina J. et al., "Chebysev Digital FIR Filter Design", Signal Processing, 76(1), 1999, 20 pages.
Karam, Lina J. et al., "Complex Chebyshev Approximation for FIR Filter Design", IEE Transaction on Circuits and Systems II: Analog and Digital Signal Processing, vol. 42, No. 3, Mar. 1995, 10 pages.
Lyons, Richard G. et al., "Understanding Digital Signal Processing (3rd Edition) [Hardcover]", Pearson, Upper Saddle River, NJ., 3rd Edition, 2011, 3 pages.
Mabande, Edwin et al., "A Time-Domain Implementation of Data-Independent Robust Broadband Beamformers With Low Filter Order", Workshop on Hands-free Speech Communication and Microphone Arrays (HSCMA) Edinburgh, UK, May 2011, 5 pages.
Mabande, Edwin et al., "Design of Robust Superdirective Beamformers As a Convex Optimization Problem", IEEE International Conference on Acoustics, Speech and Signal Processing (ICASSP 2009), Apr. 2009, 4 pages.
Mabande, Edwin et al., "Towards Superdirective Beamforming With Loudspeaker Arrays", In Conf. Rec. International Congress on Acoustics, 2007, 6 pages.
Panzer, Joerg et al., "The Use of Continuous Phase for Interpolation, Smoothing and Forming Mean Values of Complex Frequency Response Curves", 116th AES (Audio Engineering Society) Convention, Berlin, Germany, Convention Paper 6005, May 2004, 9 pages.
Potchinkov, Alexander et al., "The Design of FIR Filters in the Complex Plane by Convex Optimization", Signal Processing, 46(2), Oct. 1995, 20 pages.
Saramaeki, Tapio et al., "Finite Impulse Response Filter Design", S.K. Mitra and J.F. Kaiser, editors, Handbook for Digital Signal Processing, Chapter 4, John Wiley & Sons, Inc., 1993, 123 pages.
Smith, Julius O., "Spectral Audio SIgnal Processing", W3K Publishing. [online] <http://ccrma.stanford.edu/~jos/sasp.>, Center for Computer Research in Music and Acoustics (CCRMA), 2011, 13 pages.
Smith III, Julius O., "Introduction to Digital Filters With Audio Applications", W3K Publishing [online], [retrieved on: Jun. 22, 2017], Retrieved from, <https://www.createspace.com/1000185797>, 2007, 1 page.

* cited by examiner

FIR FILTER COEFFICIENT CALCULATION FOR BEAM-FORMING FILTERS

CROSS-REFERENCE TO RELATED APPLICATIONS

This application is a continuation of copending International Application No. PCT/EP2015/069291, filed Aug. 21, 2015, which is incorporated herein by reference in its entirety, and additionally claims priority from European Application No. EP 14182043.1, filed Aug. 22, 2014, and German Application No. 102015203600.6, filed Feb. 27, 2015, both of which are incorporated herein by reference in their entirety.

The present invention deals with calculating FIR filter coefficients for beam-forming filters of a transducer array such as an array of microphones or loudspeakers, for example.

BACKGROUND OF THE INVENTION

Beam-forming technologies as are employed in the audio field, for example, define—in the case of a microphone array, for evaluating the individual signals of the microphones, and in the case of a loudspeaker array, for reproducing the signals of the individual loudspeakers—how the signals are to be subjected to individual filtering by using a respective time-discrete filter. For broadband applications such as music, for example, coefficients are determined for said time-discrete filters from the specification of the optimum frequency responses.

Literature on beam-forming and signal driving almost exclusively deals with the design of the driving weights within the frequency domain. In this context, one implicitly assumes that FIR filters within the time-domain are determined by inverse discrete Fourier transformation (DFT), referred to as FFT. This approach may be interpreted as frequency sampling design [Smi11, Lyo11], a very simple filter design method having various disadvantages: the frequency response of the filters may be indicated, within an equidistant raster, over the entire time-discrete frequency axis up to the sampling frequency. If no sensible definitions can be provided for the frequency response for individual frequency domains (e.g., very low frequencies wherein no satisfactory directional efficiency is possible, or high frequencies wherein no pin-pointed influencing of the emission can take place due to spatial aliasing), there will be the risk that the resulting FIR filters cannot be used (e.g. excessive gain values at specific frequencies due to heavy fluctuations between the frequency sampling points, etc.)

The resulting FIR filters accurately map the defined frequency response within the frequency raster given by the DFT; however, the frequency response may adopt any values between the raster points. This frequently leads to impracticable designs exhibiting intense oscillations of the resulting frequency response.

In addition, in the frequency sampling design, the length of the FIR filter automatically results from the resolution of the defined frequency response (and vice versa).

Filters created by means of frequency sampling design are prone to time-domain aliasing, i.e., to periodic convolution of the impulse responses (e.g., [Smi11]). To this end, additional techniques such as zero-padding of the DFTs or windowing of the generated FIR filters may possibly be used.

An alternative approach consists in determining the FIR coefficients directly within the time-domain in a one-stage process [MDK11]. In this context, the emission behavior of the array for a defined raster of frequencies is represented directly as a function of the FIR coefficients of all transducers (e.g., loudspeakers/microphones) and is formulated as a single optimization problem, the solution of which simultaneously determines the optimum filter coefficients for all beam-forming filters. What is problematic here is the extent of the optimization problem, both with regard to the number of variables to be optimized (filter length multiplied by the number of beam-forming filters) and with regard to the dimension of the defining equations and, possibly, secondary conditions. The latter dimension is typically proportional both to the number of frequency raster points and to the spatial resolution at which the desired beamformer response is established. As a result of this rapidly increasing complexity, this method is limited to arrays having a small number of elements and to very small filter orders. For example, [MSK11] microphone arrays comprising six elements and having a filter length of 8 are used.

SUMMARY

According to an embodiment, a device for calculating FIR filter coefficients for beam-forming filters of a transducer array may have: first calculating means for calculating frequency domain filter weights of the beam-forming filters for a predetermined frequency raster so as to obtain target frequency responses for the beam-forming filters, so that application of the beam-forming filters to the transducer array approximates a desired directional selectivity; and second calculating means for calculating the FIR filter coefficients for the beam-forming filters so that frequency responses of the beam-forming filters approximate the target frequency responses; further including a target frequency response modifier connected between the first calculating means and the second calculating means so as to modify the target frequency responses of the beam-forming filters as obtained by the first calculating means, so that the second calculating means calculates the FIR filter coefficients for the beam-forming filters in such a manner that the frequency responses of the beam-forming filters approximate the target frequency responses in a form modified by the target frequency response modifier, said modification including frequency domain smoothing and/or for each beam-forming filter, leveling of a phase response, adjusted by $2\pi$ phase jumps, of the target frequency response of the respective beam-forming filter by removing a linear phase function portion, and storing a delay for the respective beam-forming filter, said delay corresponding to a slope of the linear phase function portion.

According to another embodiment, a method of calculating FIR filter coefficients for beam-forming filters of a transducer array may have the steps of: calculating frequency domain filter weights of the beam-forming filters for a predetermined frequency raster so as to obtain target frequency responses for the beam-forming filters, so that application of the beam-forming filters to the transducer array approximates a desired directional selectivity; and modifying the target frequency responses of the beam-forming filters, said modification including frequency domain smoothing and/or for each beam-forming filter, leveling of a phase response, adjusted by $2\pi$ phase jumps, of the target frequency response of the respective beam-forming filter by removing a linear phase function portion, and storing a delay for the respective beam-forming filter, said delay corresponding to a slope of the linear phase function portion; and calculating the FIR filter coefficients for the beam-forming filters so that frequency responses of the beam-forming filters approximate the target frequency responses in a form modified by the target frequency response modifier.

According to another embodiment, a non-transitory digital storage medium may have a computer program stored thereon to perform the method of calculating FIR filter coefficients for beam-forming filters of a transducer array, which method may have the steps of: calculating frequency domain filter weights of the beam-forming filters for a predetermined frequency raster so as to obtain target frequency responses for the beam-forming filters, so that application of the beam-forming filters to the transducer array approximates a desired directional selectivity; and modifying the target frequency responses of the beam-forming filters, said modification including frequency domain smoothing and/or for each beam-forming filter, leveling of a phase response, adjusted by 2π phase jumps, of the target frequency response of the respective beam-forming filter by removing a linear phase function portion, and storing a delay for the respective beam-forming filter, said delay corresponding to a slope of the linear phase function portion; and calculating the FIR filter coefficients for the beam-forming filters so that frequency responses of the beam-forming filters approximate the target frequency responses in a form modified by the target frequency response modifier when said computer program is run by a computer.

One idea underlying the present application consists in having found that the effectiveness of calculating FIR filter coefficients for beam-forming filters for transducer arrays such as arrays of microphones or loudspeakers, for example, can be increased if said calculation is performed in two stages; namely, on the one hand, by calculating frequency domain filter weights of the beam-forming filters within a predetermined frequency raster, i.e., coefficients describing the transfer functions of the beam-forming filters within the frequency domain and/or in each case for a respective frequency or for a sinusoidal input signal having a respective frequency, so as to obtain target frequency responses for the beam-forming filters, so that applying the beam-forming filters to the array approximates a desired directional selectivity, and followed by calculating the FIR filter coefficients for the beam-forming filters, i.e., of coefficients describing the impulse response of the beam-forming filters within the time domain, such that the frequency responses of the beam-forming filters approximate the target frequency responses. The two-stage system enables independent selection of the frequency resolution as results from direct Fourier transformation of the impulse responses described by the FIR filter coefficients. In addition, both in the calculation of the beam-forming driving weights in the frequency domain and in the calculation of the time-domain FIR filter coefficients, specific secondary conditions may be defined so as to influence the respective calculation in a pin-pointed manner.

BRIEF DESCRIPTION OF THE DRAWINGS

Embodiments of the present invention will be detailed subsequently referring to the appended drawings, in which.

DETAILED DESCRIPTION OF THE INVENTION

Figure 1:
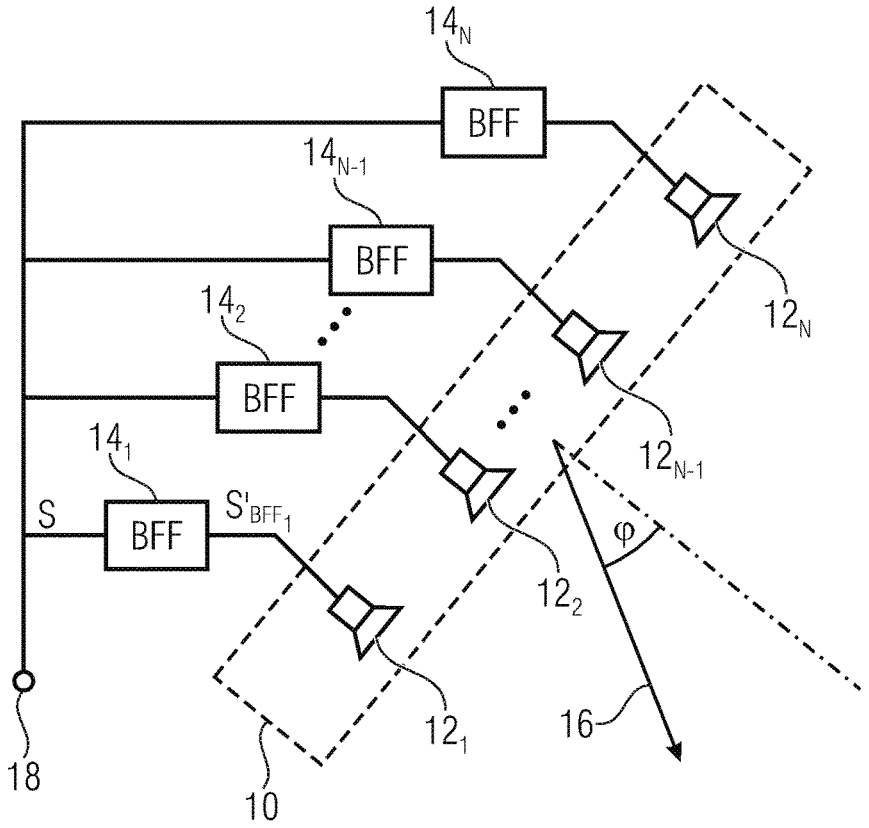
FIG. 1 shows a schematic block diagram of a loudspeaker array having beam-forming filters for which the embodiments of the presence application might be used.

FIG. 1 initially shows an example of an array 10 of loudspeakers 12 which is to be enabled, by applying beam-forming filters (BFF) 14, to exhibit a desired directional selectivity, i.e., to emit in a specific direction 16, for example. In FIG. 1, an index is used, for example, for distinguishing the individual loudspeakers 12 from one another. The number N of the loudspeakers 12 may be two or more. As can be seen in FIG. 1, each loudspeaker $\mathbf{12}_n$, wherein i=1 . . . N, has a beam-forming filter $\mathbf{14}_n$ connected upstream from it which filters the corresponding loudspeaker input signal. In particular, the loudspeaker $\mathbf{12}_n$ here is connected to a common audio input 18 via its corresponding beam-forming filter $\mathbf{14}_n$. This means that all loudspeakers $\mathbf{12}_n$ obtain the same audio signal, which is, however, filtered by the respective beam-forming filter $\mathbf{14}_n$. The audio signal s( ) at the input 18 is a time-discrete audio signal consisting of a sequence of audio samples, and the beam-forming filters $\mathbf{14}_n$ are designed as FIR filters and thus convolute the audio signal with the impulse response of the respective beam-forming filter $\mathbf{14}_n$, said impulse response being defined by the FIR filter coefficients of the respective beam-forming filter $\mathbf{14}_n$. For example, if the audio signal at the input 18 is described by the sequence of audio samples s(k), the resulting filtered loudspeaker signal $s'_{BFF_n}(k)$ for the respective loudspeaker $\mathbf{12}_n$ might be described, e.g., as:

$$s'_{BFF_n}(k) = \sum_{i=o}^{I_{BFF_n}} h_{BFF_n}(i) \cdot s(k-i),$$

wherein $h_{BFF_n}(i)$ are the filter coefficients of the FIR filter $\mathbf{14}_n$ with the FIR order $I_{BFF_n}$ and/or the filter length $I_{BFF_n}+1$.

The art of FIR coefficient calculation consists in that the loudspeaker array 10 emits the audio signal at the input 18 at a desired directional selectivity, e.g., in the desired direction 16. In this context, FIG. 1 depicts by way of example only that the loudspeakers $\mathbf{12}_n$ are equidistantly arranged in a line and that the array 10 is a linear array of loudspeakers. However, a two-dimensional arrangement of loudspeakers would also be feasible, just as a non-uniform distribution of the loudspeakers 12 in the array 10 and just as an arrangement deviating from an arrangement along a straight line and/or a plane would be feasible. The emission direction 16 may be measured, for example, by an angular deviation of the direction 16 from a midperpendicular of the straight line and/or of the face along which the loudspeakers 12 are arranged. However, there are two possibilities of variation here as well. For example, it is possible that the emission is advantageously intended to be audible at a specific place upstream from the array 10. However, the filter coefficients h of the beam-forming filters $\mathbf{14}_n$ may also be selected even more accurately, such that the directional characteristic, or directional selectivity, of the array 10 upon emission experiences not only a maximum in a specific direction 16 but also meets other desired criteria, such as an angular emission width, a specific frequency response in a direction 16 of maximum emission or even a specific frequency response if a region including the direction 16 and directions around same is concerned.

Figure 2:
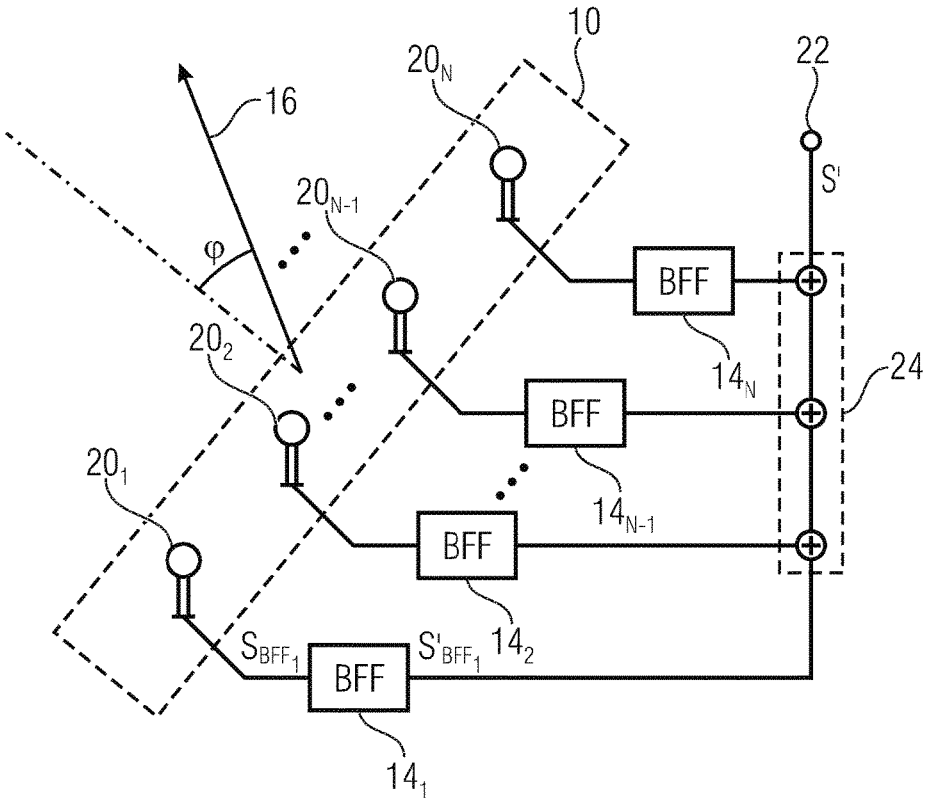
FIG. 2 shows a schematic block diagram of a microphone array having beam-forming filters for which the embodiments of the presence application might be used.

Embodiments of an effective manner of calculating the above-mentioned FIR filter coefficients of the beam-forming filters $\mathbf{14}_n$ of a transducer array 10 will be described below. However, the embodiments described below are also applicable for calculating the beam-forming filters of other arrays of transducers, such as of ultrasonic transducers, antennae or the like. Transducer arrays intended for reception may also be the object of said beam-forming. For example, embodiments described below may also be applied for designing the beam-forming filters of a microphone array, i.e., for calculating their FIR filter coefficients. FIG. 2 shows such a microphone array. The microphone array of FIG. 2 is also provided, by way of example, with reference numeral 10 but, at any rate, is composed of microphones $\mathbf{20}_1 \ldots \mathbf{20}_N$. With regard to the arrangement of the microphones, what was said with regard to the loudspeakers 12 of FIG. 1 shall apply to them as well: they may be unidimensionally arranged along a line or two-dimensionally arranged along a face, wherein the line may be straight and the face may be a plane, and uniform distribution is also not required. Each microphone generates a received audio signal $s'_{BFF_i}$ and is connected, via a respective beam-forming filter $\mathbf{14}_n$, to a common output node 22 for outputting the received audio signal s', so that the filtered audio signals $s'_{BFF_n}$ of the beam-forming filters $\mathbf{14}_n$ additively contribute to the audio signal s'. To this end, an adder 24 is connected between the outputs of the beam-forming filters $\mathbf{14}_n$ and the common output node 22. The beam-forming filters are again configured as FIR filters and form the filtered audio signal $s'_{BFF_n}$ from the respective audio signal of the respective microphone $\mathbf{20}_n$, i.e., $s'_{BFF_n}$, for example in accordance with $$s'_{BFF_n}(k) = \sum_{i=o}^{l_{BFF_n}} h_{BFF_n}(i) \cdot S_{BFF_n}(k-i),$$

wherein $h_{BFF_n}$ again are the FIR filter coefficients of the beam-forming filters $\mathbf{14}_n$. Summation on the part of the adder 24 then results in the overall output signal s' in accordance with $$s'(k) = \sum_{n=1}^{N} s'_{BFF_n}(k).$$

The subsequent embodiments in turn enable the microphone array 10 of FIG. 2 to comprise a desired directional selectivity, or directional characteristic, so as to predominantly or exclusively record, or be sensitive to, the scene of sounds coming from a specific direction 16, so that it will be reflected in the output signal s'; the direction 16 may again be defined, as in the case of FIG. 1, by the angular deviation φ or, in the two-dimensional case, φ and θ from a midperpendicular of the array 10, and the desired directional selectivity may possibly be more accurate than merely the indication of a direction of maximum sensitivity, namely more accurate with regard to the spatial dimension or frequency dimension.

Figure 3:
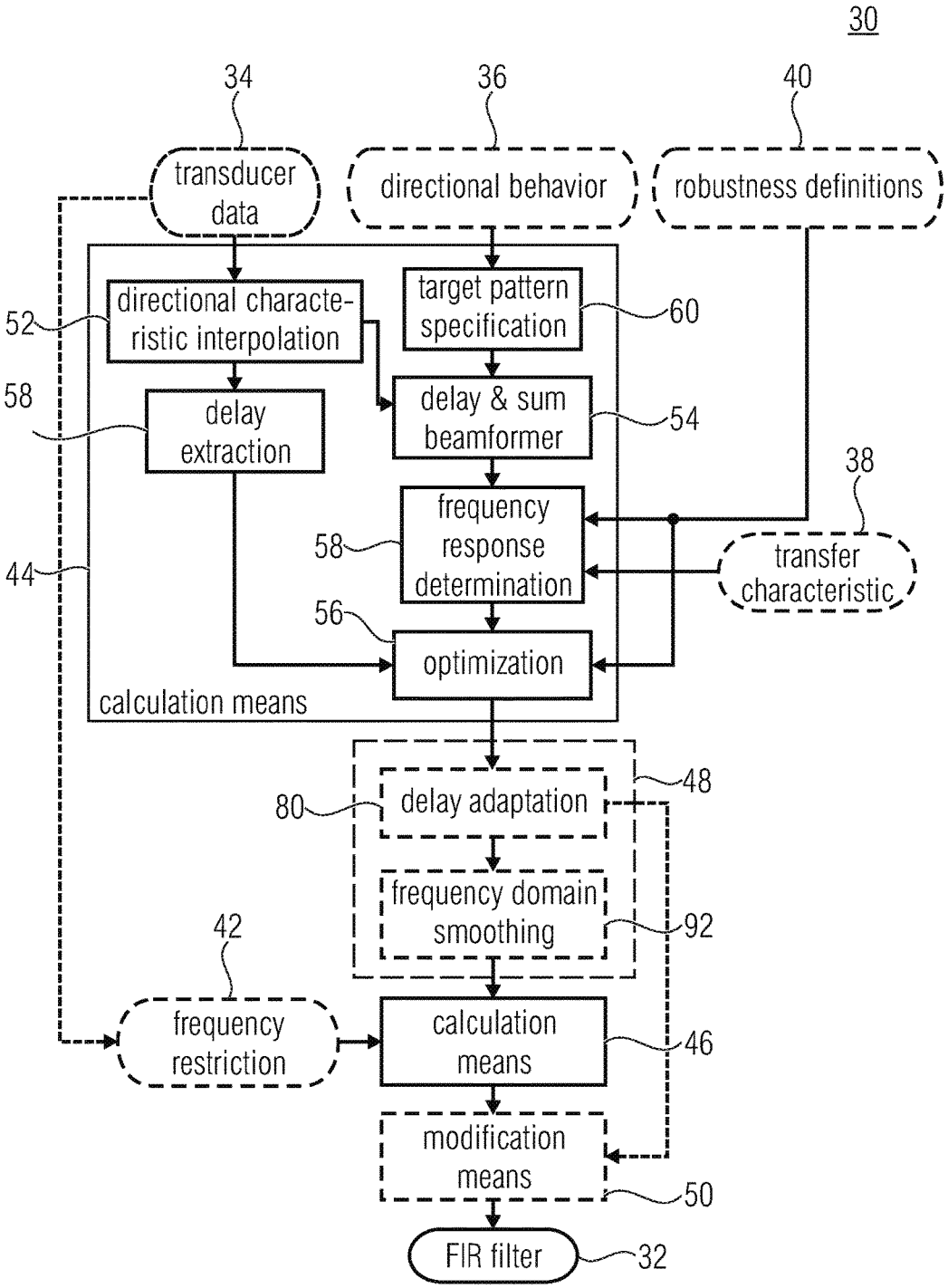
FIG. 3 shows a block diagram of a device for calculating FIR filter coefficients for the beam-forming filters in accordance with an embodiment.

FIG. 3 now depicts an embodiment of a device for calculating FIR filter coefficients for the beam-forming filters of a transducer array, such as an array of microphones as was shown in FIG. 2, for example, or an array of loudspeakers as was shown in FIG. 1, for example.

The device is generally indicated by 30 and may be implemented, e.g., in software executed by a computer, in which case all of the means and modules described below may be different parts of a computer program, for example. Implementation in the form of dedicated hardware, such as in the form of an ASIC or in the form of a programmable logic circuit, e.g., an FPGA, is also possible, however.

The device 30 calculates the FIR filter coefficients 32 such as the above-mentioned $h_{BFF_n}$ for the beam-forming filters $\mathbf{14}_n$ specifically for the array 10, for which purpose the device 30 comprises interfaces for obtaining information about the array 10 or information about the desired directional selectivity. FIG. 3 shows by way of example that the device 30 obtains transducer data 34 from external sources, which transducer data 34 will be described in more detail below by way of example and indicate, for example, the positions and orientations of the transducer elements, i.e., for example, of the loudspeakers or microphones, as well as their individual directional-selective sensitivities and/or emission characteristics and/or the frequency responses. Other information relates to the desired directional selectivity, for example. E.g., FIG. 3 shows that the device 30 obtains data 36 indicating the desired directional behavior of the array 10, such as a direction of maximum emission and/or sensitivity, and possibly more accurate information such as the emission behavior and/or the sensitivity about the above-mentioned maximum emission/sensitivity. The data 36 is supplemented by further data 38, for example, which may be defined to the device 30 from the outside and refer to, e.g., the desired transfer characteristic and/or the frequency response of the array 10 in the direction of the emission and/or the sensitivity of the array 10, i.e., the frequency-dependent target description of the sensitivity or emission intensity of the array, which is set with the eventual FIR filter coefficients, in a specific direction, or in specific directions. Other information may also be defined to the device 30 for calculating the FIR filter coefficients 32, such as definitions relating to a robustness of the calculated FIR filter coefficients that is complied with against deviations of the transducer data 34 of actual physical circumstances of an actually set-up array 10, said definitions being provided with reference numeral 40 in FIG. 3, as well as data about a frequency restriction 42, whose exemplary significance for calculation will be described below and is possibly related to the transducer data 34.

It should be noted that all of the information 34 to 42 which may be defined to the device 30 of FIG. 3 from the outside by way of example is optional. The device 30 might also be specifically configured for a specific array setup, and it would also be possible for the device to be specifically configured for certain settings of the other data. In the event of an input option, said input option may be implemented, for example, via an input interface, such as via user input interfaces of a computer or reading interfaces of a computer, so that, e.g., the data of one or several specific files is read.

The device of FIG. 3 includes first calculation means 44 and second calculation means 46. The first calculation means 44 calculates frequency domain filter weights of the beam-forming filters, i.e., complex-valued samples of the transfer function of the beam-forming filters. They serve to establish a target frequency response for the beam-forming filters. In particular, the first calculation means 44 calculates the frequency domain driving weights within a frequency raster defined by specific, not necessarily mutually equidistant frequencies $\omega_1 \ldots \omega_K$ such that they describe a transfer function $H_{BFF_n}$ of the beam-forming filters, which in the application of such beam-forming filters to the array 10 approximates the desired directional selectivity. A description is given below to the effect that the first calculation means uses a suitable optimization algorithm for this purpose, for example, such as a method of solving linear, square or convex optimization problems. The frequency raster may be selected, for example, in accordance with requirements placed upon the beam-forming application, such as different requirements placed upon the degree of accuracy of the defined emission within specific frequency domains, or in accordance with other requirements, e.g. regarding the subsequent FIR time-domain design method mentioned below, such as in dependence of a sampling rate that may be used for defining the desired frequency response.

While the first calculation means 44 thus describes the transfer function $H_{BFF_n}$ of the beam-forming filters over the frequency $\omega$ and/or calculates the transfer function, namely at specific nodes $\omega_1 \ldots \omega_K$, for example, the second calculation means 46 is intended to determine those FIR filter coefficients of the beam-forming filters which describe the impulse responses of the beam-forming filters. The second calculation means 46 performs the calculation such that the frequency responses of the beam-forming filters as correspond to the FIR filter coefficients via the connection between the transfer function and the impulse response approximate the target frequency responses defined by the first calculation means 44. In accordance with the subsequent implementation description, also the second calculation means 46 uses an optimization which in turn may be configured as a method of solving linear, square or convex optimization problems.

The mode of operation of the device 30 of FIG. 3 will be described below in more detail for a possible case of implementation. The description also refers to various implementation possibilities. According to one implementation possibility, the first calculation means 44 performs the calculation by solving a first optimization problem according to which a deviation between a directional selectivity of the array, as results from the frequency domain driving weights $H_{BFF_n}(\omega_k)$, and the desired directional selectivity, which may be defined by the data 34 and/or 38, is minimized. As is shown in FIG. 3, the first calculation means 44 may, for this purpose, use the robustness definitions 40 as a secondary condition of the optimization problem, and the transducer data 34 is used for setting, or defining, the connection between the optimization variables, namely the frequency domain driving weights $H_{BFF_n}(\omega_k)$, on the one hand, and the resulting directional selectivity, on the other hand. The description which follows will thereafter address possible implementations of the second calculation means 46, which will result in that the second calculation means may also solve an optimization problem so as to perform the calculation. According to the second optimization problem underlying the second calculation means 46, a deviation from the target frequency responses $H_{BFF_n}(\omega_k)$ is minimized within the frequency domain. As was mentioned before, the FIR filter coefficients to be calculated by the second calculation means 46 correspond to the impulse response, and the means 46 tries to calculate them, in accordance with the following embodiments, by means of optimization such that the transfer functions corresponding to said impulse responses approximate the transfer functions $H_{BFF_n}(\omega_k)$—as have been calculated by the first calculation means 44—as much as possible. It becomes clear from the description which follows that in the optimization of the calculation means 46, secondary conditions specifically provided for this optimization and defined by the data 42 may advantageously be taken into account. The description which follows will also address a target frequency response modification means 48 which is optionally provided between the two calculation means 44 and 46 and which possibly modifies the target frequency responses of the beam-forming filters as have been determined by the first calculation means 44 before they are used as an approximation target by the second calculation means 46. Various modification possibilities will be described. They serve to avoid losses in effectiveness in the calculation of the FIR filter coefficients 32 by the calculation means 46 or even calculation of FIR filter coefficients which are poorer in terms of quality. According to one of the modification possibilities, the device 30 may possibly also include optional modification means 50 for modifying the calculated FIR filter coefficients as have been calculated by the second calculation means 46, so that the respective modification is taken into account. In the following, FIG. 3 also describes, by way of example, a possible modular setup for the first calculation means 44 and the target frequency response modification means 48, but the respective modular setup is only exemplary.

As has already been outlined above, the device 30 of FIG. 3 may use solutions to optimization problems for finding the time-domain FIR filters and/or the FIR filter coefficients for the beam-forming filters. The time-domain FIR filter calculation by means of optimization-based filter design methods avoids, as will described below, both the disadvantages of frequency sampling design and the complexity of and, thus, the requirements placed upon the calculating time and resources, such as the main memory, for example, for direct time-domain design of the filters as have been described in the introductory part of the present application. According to FIG. 3, designing the beam-forming filters is performed in a two-stage process by the first and second calculation means 44 and 46:

In a first stage as provided by the first calculation means 44, the frequency response of the beam-forming driving filters BFF within the frequency domain is designed within a defined frequency raster $\omega_k$ which establishes a certain frequency resolution, such as $\Delta\omega=\omega_k-\omega_{k-1}$, for example. However, the frequency raster need not be selected to be equidistant but may also be non-uniform. In this context, one may fall back on the beam-forming techniques described in literature. Optimizations may be used. Such a frequency domain optimization method is described in [MSK09], for example.

In a second stage as provided by the second calculation means 46, an FIR filter is generated for each beam-forming driving filter $BFF_n$ from its target frequency response, as was defined by the first stage, by calculating said FIR filter's FIR filter coefficients $H_{BFF_n}$. Optimization methods may also be used here, so as to achieve optimum approximation of the desired frequency response for the given FIR filter arrangement, a freely selectable filter standard and possibly a number of additional secondary conditions. The frequency resolution of the FIR filter design, established by, e.g., the Nyquist frequency of the FIR filter divided by half the FIR filter length, or, to put it slightly more accurately, the Nyquist frequency (half the sampling rate) of the time-discrete system in which the beamformer and, thus, also the FIR filters are implemented, may be selected to differ from the frequency resolution of the frequency domain resolution.

The filter design process as implemented by the device 30 provides, according to the subsequently described implementations, a plurality of correlated individual measures and provisions. All in all they enable generation of particularly stable, robust driving filters and/or beam-forming filters. The mode of operation of the device 30 will now be described in detail. However, individual ones of the measures may also be omitted, depending on the case of application.

As has already been mentioned above, the transducer properties, i.e., the properties of, e.g., microphones and/or loudspeakers, are taken into account in the first calculation by the calculation means 44. The transducer data 34 describes the transducer properties typically obtained from measurements or from modeling, e.g., simulation. The transducer data 34 may represent, for example, the direction-dependent and frequency-dependent transfer function of the transducers from (in the case of loudspeakers) or to (in the case of sensors and/or microphones) different points within the room. For example, a module 52 of the calculation means 44 may perform a directional-characteristic interpolation, for example, i.e., an interpolation of the transducer data 34 so as to enable the transfer function of the transducers from/to points or directions which are not contained among the original data 34, i.e., not contained within the original data sets.

The transducer data of the module 52 which have thus been obtained are used in two functional blocks, or modules 54 and 56, of the first calculation means 44, namely in a delay-and-sum beamformer module and an optimization module 56. By means of a defined target for the directional behavior of the transducer array, which specifies, for example, a desired magnitude in the emission direction(s), the delay-and-sum beamformer module 54 calculates, while using the individual transducers of the array in the respective direction for each transducer n, a delay and an amplitude weight, i.e., frequency-independent magnitudes such as a time delay and an gain factor per transducer 12 and/or 14. The optimization 56 operates within the frequency domain. It optimizes, as optimization variables, the above-mentioned frequency domain forming coefficients and/or the frequency domain driving weights $H_{BFF_n}$, i.e., frequency-dependent magnitudes. The latter optimization 56 of the frequency domain driving weights may be improved by including specific transducer transfer functions, in particular, if they strongly deviate from a behavior assumed to be ideal, such as from a monopole characteristic. For example, transducer data 34 obtained by means of measurements often comprises pure delays, such as due to the acoustic propagation, for example, and a delay extraction module 58 connected between the directional-characteristic interpolation module 52 and the optimization module 56 might be provided for removing common delay times of all transducers and/or transducer data. This simplifies the optimization process within the optimization module 56 since in this case the delays will no longer have to be included in the desired optimization target function and/or since the beam-forming filters obtained will not need to compensate for said delay of the array, which is common to all the transducers. It becomes evident from the description which follows that an advantage of using the delay-and-sum block consists in that by means of said block, a design definition—which may be implemented with a high level of robustness given the transducers used—for the frequency response of the transducer array may be obtained with a high level of sensitivity in the desired emission direction/incident direction.

It should once again be noted that the above-described inclusion of transducer properties in the calculation on the part of the calculation means 44 is merely optional, i.e., in that the definition of the data 34 as well as the modules 52 and 58 may be omitted. Rather, calculation on the part of the calculation means might also be performed on the assumption of idealized transfer characteristics. On the other hand, utilization of real transducer data 34 often enables better performance of the eventually calculated beam-forming filters.

Specification of the desired directional behavior and/or beam-forming behavior is performed via data 36 in accordance with FIG. 3. Said data 36 forms the starting point of the beamformer design by describing a desired directional characteristic. It describes, e.g., a desired emission of the desired sound in one or more directions or areas in the case of loudspeakers, or sensitivity to sound from one or more directions or areas in the case of microphones, whereas emission in and/or sensitivity to other directions/areas are to be suppressed as much as possible. This description by the data 36 is converted to a target pattern specification, e.g., by a module 60, i.e., is converted to a mathematical formulation of the desired directional behavior. The target function output by the target pattern specification 60 describes, e.g., the desired complex emission of sound in various spatial directions $\varphi$ or $\varphi$ and $\theta$. The target function may be either frequency-independent or frequency-dependent, i.e., may have different definitions for different frequencies of frequency domains. In addition, the mathematical formulation of the directional behavior may comprise one or more of the following elements:

- one or more advantageous directions or points of emission;
- directions or areas wherein the achieved emission of sound are allowed to deviate from the desired emission of sound only in a defined manner (typically defined by maximum deviations);
- areas wherein no definitions are given regarding their emission of sound, which may also be referred to as transition areas or spatial "don't care" areas;
- areas wherein emission of sound is to be minimized, optionally by means of a weighting function, so as to adapt the priority of individual sub-areas.

Generally it is to be noted that the desired complex emission of sound described by the target function is not necessarily limited to directions. Other arguments are also possible, for example, e.g., the desired emission along a line or across a surface/a volume.

The following applies with regard to the robustness definitions. In the context of beam-forming applications, robustness refers to the property of exhibiting only a relatively small amount of degradation of the emission behavior in case of deviations of the transducer array 10 or of the transfer system, such as deviations of the driving filters from the ideal behavior, positioning errors of the transducers within the array, or deviations from the modeled transfer behavior. A measure of robustness that is frequently employed for microphone arrays, for example, is the so-called white noise gain [BW01, MSK09], ([WNG]), which results as a quotient of the signal magnitude in the incident direction and of the $L_2$ standard of the driving weights for the array. This measure may also be sensibly employed for loudspeaker arrays [MK07]; here, the signal magnitude in the desired emission direction adopts the role of the magnitude in the incident direction.

As was shown in the above paragraph, the magnitude in the emission direction (or incident direction) in relation to an allowed standard of the driving weights has a direct effect on the WNG and, thus, on robustness. Similarly, the level that may be achieved in the emission direction is dependent both on the maximally admissible amount of the driving weights and on the emission characteristics of the transducers. It may therefore be useful to specify the magnitude (or amplitude of the desired emission pattern) such that requirements placed both upon the robustness and upon the emission magnitude achieved are met. In order to obtain a good starting point for this specification it is possible to use the following method:

On the basis of the desired emission direction, or the data 36 regarding the desired directional behavior, the transfer functions of the driving filters for the delay-and-sum beamformer (DSB) are created within the module 54. This means that the module 54 assumes simple filters which depend only on the positions of the transducers and on the emission direction and consist merely of a frequency-independent gain value and a frequency-independent delay, in each case per transducer element. On the basis of the desired directional behavior 36 and while taking into account the transducer data 34, only such frequency-independent values are calculated by the module 54 per transducer. Thus, a DSB basically corresponds to the setup of FIG. 1 or 2; however, simpler BFFs are used, namely such BFFs which perform a time delay and frequency-independent gain. While the directional efficiency of such a DSB in particular for low frequencies is small, such a DSB exhibits high WNG values and, thus, a good robustness.

On the basis of this DSB driving filter set (consisting of merely the frequency-independent gain value and the frequency-independent delay per transducer element), the emission of the array in the desired emission direction is calculated/simulated. As has already been mentioned, the modeled or measured transducer characteristics from the data 34 are incorporated in the calculation of these frequency-independent pairs of values per transducer element on the part of the module 54.

The frequency response of the transducer array which results in the emission direction from the DSB driving filter set of the module 54 may be referred to as a reference frequency response (or magnitude response) and may be used in the subsequent steps of calculation on the part of the calculation means 44. The advantage of this approach consists in that thereby, there is a definition for the magnitude which may be implemented by the transducer array within the defined maximum modulation values for the individual transducers, and which (since it results from a DSB design) exhibits good robustness properties, or may be designed to exhibit good robustness properties.

According to the example of FIG. 3, the calculation means 44 comprises a further module, namely a module 58 which determines the final specification of the frequency response of the transducer array in the emission direction on the basis of the obtained reference magnitude response of the module 54 in combination with the definitions 38 for the desired frequency response. This means that the starting point for determining the module 58 is constituted by the frequency response of the transducer array as has so far been determined by the DSB values of the module 54, i.e., by that frequency response which results for the transducer array with the DSB values in the corresponding direction. On the basis of this magnitude response, modifications are performed by the module 58. For example, modifications are performed on the reference magnitude response so as to equalize the frequency response, for example. Also, the directional efficiency of the array may be increased within certain limits (either globally or for specific frequencies) by reducing the magnitude response in the emission direction in relation to the reference magnitude response. In this context, utilization of the DSB reference design and its WNG value allows a fair assessment of the robustness properties of the final design specification.

In an optional example of application, psychoacoustic findings are incorporated in the frequency-response determination 58. In this context, for example, one may exploit the finding that specific frequency domains of a signal are more important for the perception of a sound event and that therefore an emission in other frequency domains which is less advantageous since it is less directed may be compensated for or rendered less perceivable by specifically raising said frequency domains. It should be noted here that this equalization is independent of the signal and also is limited to only one emission characteristic, i.e., is not based on psychoacoustic masking between various emission characteristics or audio signals.

On the basis of the specific frequency-response target for the transducer array as has been determined by the module 58, optimization is then performed within module 56. The design of the beam-forming filters here is effected within the frequency domain for a number of discrete frequencies $\omega_k$. In the context of the present application, optimization methods based on convex optimization are advantageously employed [M07, MSK09]. Said optimization methods enable the best approximation possible, in terms of optimization, of the emission characteristic defined or selected by the module 58 as is determined by the modules 60, 54 and 58 on the basis of the data 36, specifically with regard to a selectable error standard, e.g., the $L_2$ (least squares) or the $L_\infty$ standard (Chebyshev, minimax standard). The result of the optimization performed within the module 56 is a complex driving value for each discrete frequency, so that a vector $H_n(\omega_k)$ of complex other weights results per transducer n. Any measured or modeled transducer data, or the data 34, may be incorporated into the optimization problem, solved by the module 56, so as to obtain driving filter frequency responses $H_n$ optimized with regard to the frequency response and the emission characteristic. In addition, the optimization-based approach enables numerous secondary conditions which may relate to both the achieved emission and the driving weights. For example, a limitation for the minimum white noise gain may be established. Similarly, it is possible to establish maximum amounts for the driving weights so as to limit the driving of the individual transducers.

Figure 4:
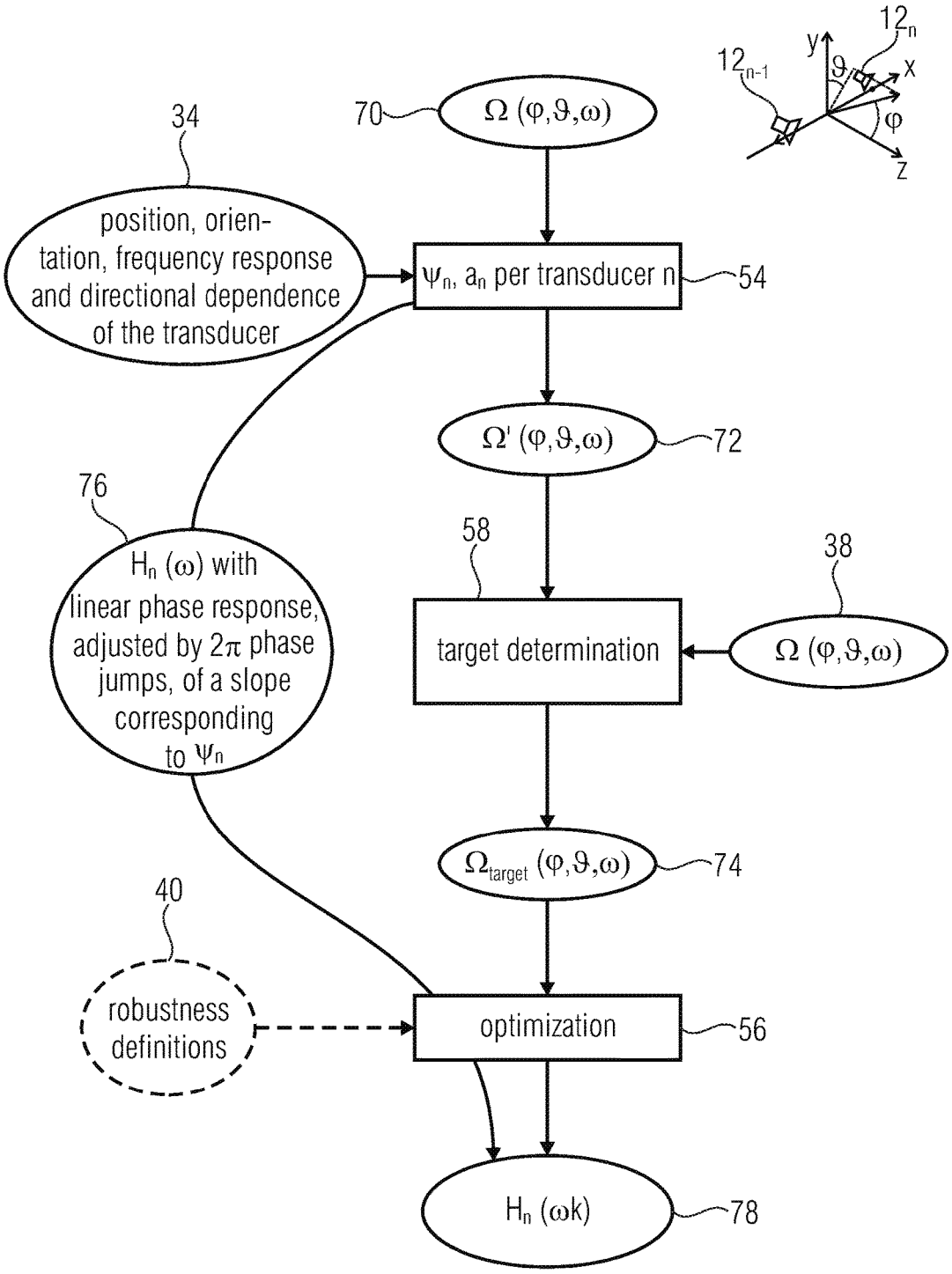
FIG. 4 schematically illustrates how, in accordance with an embodiment in FIG. 3, the optimization-based calculation of the target frequency responses of the beam-forming filters is performed step by step via modeling of a DSB design.

Summarizing the above description of the possible implementation of the mode of operation of the first calculation means 44 once again in an illustrative manner, reference shall be made to FIG. 4. The starting point for calculating the target frequency response on the part of the calculation means 44 is constituted by the desired directional selectivity, which is described by Ω and provided with reference numeral 70 in FIG. 4. The desired directional selectivity Ω is illustrated by way of example here as a function Ω dependent on the emission angle φ. As has been indicated above, the directional dependence may also be defined differently from being angular, however. Moreover, FIG. 4 indicates by a dashed σ that the desired directional selectivity 70 may be defined in terms of space rather than only within a plane. At the top right, FIG. 4 indicates how the angles φ and σ might be defined. The desired directional selectivity might also already contain a frequency dependence, i.e., Ω might depend on ω. As far as that goes, mention has been frequently been made of a "frequency response" Ω since frequencies determined in a directionally dependent manner are attenuated to a larger or a lesser degree. This frequency response Ω is to be distinguished, however, from the frequency response $H_n(\omega_k)$ for the individual beam-forming filters as are to be calculated by the calculation means 44. Both act as filters having transfer functions as determined by the dependence on ω, but the frequency response Ω is influenced by the eventually calculated frequency responses $H_n$ of the individual beam-forming filters.

The desired directional selectivity 70 as defined by the data 36 is now to be achieved with the specific transducer array. At the top right of FIG. 4, the elements of the array are assumed to be loudspeakers by way of example, but as has already been mentioned, an array consisting of other transducers such as microphones, for example, is also possible. Thus, the array is constituted by specific transducer positions, transducer orientations, a transducer frequency response, which frequency response may in turn be dependent on the direction, and/or a directional dependence of the emission and/or of the sensitivity, which, conversely, may in turn be dependent on the frequency. Within the module 54, a pair of values $\psi_n$ and $a_n$, namely a frequency-independent delay ψ and an gain value a which is also independent of the frequency, are determined for each transducer n, so that assuming that only these frequency-independent values are applied in the BFFs of the transducers n the directional selectivity Ω' 72 results which is dependent on the direction, i.e., dependent on φ and optionally on σ and dependent on the frequency, i.e., dependent on ω. The determination within the module 54 is performed such that the desired directional selectivity 70 is achieved or approximated as much as possible. Of course, this is possible only to a limited extent since merely frequency-independent delay and/or gain are determined per transducer n. To make up for this, however, the directional selectivity Ω' is achieved with a high level of robustness. As was described, Ω' 72 now serves as a starting point for the actual desired directional selectivity 74 as is intended to underlie the optimization 56 at a later point in time. As far as the directional selectivity 72 is concerned, one makes use of the prior knowledge that it is robust on account of its DSB property. The module 58 now modifies the directional selectivity Ω' 72 such that it comes closer to the desire for a specific frequency dependence of the directional selectivity. For example, within the module 58, a frequency dependence of the directional selectivity Ω is defined by the transfer characteristic 38 in a predefined direction $\varphi_0$ or $\varphi_0$, $\vartheta_0$, e.g. in the direction of the maximum emission and/or maximum selectivity, i.e. in that direction for which Ω is at a maximum at 70. The optimization target 74 of the optimization 56 is also a directional selectivity $\Omega_{target}$ that is dependent on the frequency and direction, and the optimization 56 is performed such that it finds target frequency responses and/or transfer functions $H_n(\omega_k)$ for the beam-forming filters n such that by means of their utilization in the beam-forming filters of the transducer array 10, the optimization target 74 is achieved or approximated as well as possible, i.e. such that a deviation in terms of a specific criterion is minimized. Thus, the optimization 56 might be considered a fine alignment of beam-forming filter transfer functions 76 which, when used for the beam-forming filters, are equivalent to the frequency-independent delays and gains. However, it is to be ensured that the DSB design is nevertheless actually used only for formulating the optimization target and that the frequency domain optimization 56 may start independently of the DSB design. In other words, according to an advantageous embodiment, the DSB design is not adapted and/or is used as a basis which thus serves merely as a master for the desired frequency response in the emission direction, i.e. for defining the optimization target, and the optimization algorithm 56 starts from scratch, i.e. without any knowledge about the DSB weighting. The frequency-independent delays and gains $\psi_n$ and $a_n$ as are calculated within module 54 may be similarly generated, specifically, by filters with transfer functions $H_n$ whose linear phase response, adjusted by 2π phase jumps, exhibits a slope corresponding to $\psi_n$, and whose magnitude, or amount, corresponds to $a_n$ and is therefore constant. Depending on the case of application, one may suitably set the frequency nodes or sampling points $\omega_k$, wherein k=1 . . . K, for which the optimization 56 is performed. Since the transfer function $H_n$ is a complex-valued function, the variables to be optimized are therefore 2·N·K, wherein N is the number of transducers and K is the number of frequency samples for which the optimization 56 is performed. The optimized target frequency responses 78 resulting from the optimization 56 may be achieved by optionally subjecting the optimization to secondary conditions as well, such as secondary conditions regarding meeting of specific robustness criteria defined by the data 40. Thus, the optimization 56 may in particular be a square program having a secondary condition stating that a specific robustness measure must not be fallen below.

It has been pointed out several times above that calculation of the target frequency responses 78 might also be performed differently.

In the embodiment of FIG. 3, before the target frequency response 78 of the beam-forming filters is taken as a basis for the optimization within the second calculation means 46, one or more modifications are performed which are optional, however, as was mentioned above.

As will be described below, specifically, the frequency responses of the individual driving filters n results from the driving weights $H_n(\omega_k)$, obtained in the optimization 56, since the weights of the filter are actually removed in each case. Said filters often contain a marked delay, which is reflected, for example, by the phase and/or group delay time. Said delay is in the way of the further processing stages, such as, in particular, the subsequent optimization performed within the second calculation means 46. The optional smoothing step described below is also rendered more difficult or involves a clearly higher resolution of the frequency raster during the optimization 56 performed within the first calculation means since smoothing involves determining the continuous phase by means of "phase unwrapping". The higher the increase, contained within the frequency response, of the phase function, the more difficult it will be to correctly detect and subsequently compensate for the phase jumps. This affects the correctness of the phase-unwrapping algorithms.

In addition, it is advantageous for the optimization step performed within the second calculation means 46 if the optimization target there, i.e. the target frequency response 78, exists in a version that is as close as possible to a zero-phase frequency response, i.e. wherein the phase terms caused by delays are eliminated as much as possible. Further requirements regarding the optimization step performed within the calculation means 46 will be described in more detail below. Generally, the following aspects are to be heeded:

The causality of the resulting filters is not relevant at this stage of the design process. One may work with non-causal desired frequency responses, which are close to zero-phase transfer functions, for the driving filters. The causality may be rendered causal again following the FIR design (by re-inserting the extracted delays, possibly supplemented by additional delays).

The extraction of the delays from the transducer data, which was already set forth above in terms of the inclusion of transducer properties, already reduces some of the delay contained within the desired frequency response $H_n$ 78 of the driving filter n. However, this may not be usable here and there and may be supplemented by the module 80 for delay adaptation. The following approach may be used for adapting the gain values.

Adaptation is performed individually for each filter $BFF_n$.

- The continuous phase of the frequency response is determined by an algorithm for "phase unwrapping".
- The linear proportion (i.e. the increase) of the phase function is determined by a least squares fit with a first-order polynomial. The linear proportion of the delay may be determined therefrom.
- Optionally: The linear delay proportion is rounded or rounded down to an integral multiple of the sampling period. This may simplify subsequent recombination, which will then involve only a shift of the impulse response (e.g. by putting in front a corresponding number of zeros or by implementing these delays in the form of a delay line).
- On the basis of this linear term, a vector is calculated from complex exponentials which has a phase response that is negated in relation to this linear phase term.
- The delay of the frequency response is adapted by multiplying the original frequency response 78 by this vector of complex exponentials.
- The calculation specification may be readily varied, e.g. decomposing the complex frequency response within the magnitude response (better: zero-phase frequency response) and continuous phase, determining of the linear delay proportion, subtracting said proportion from the continuous phase, followed by recombining magnitude and phase or by transferring both parts to subsequent smoothing.

Figure 5:
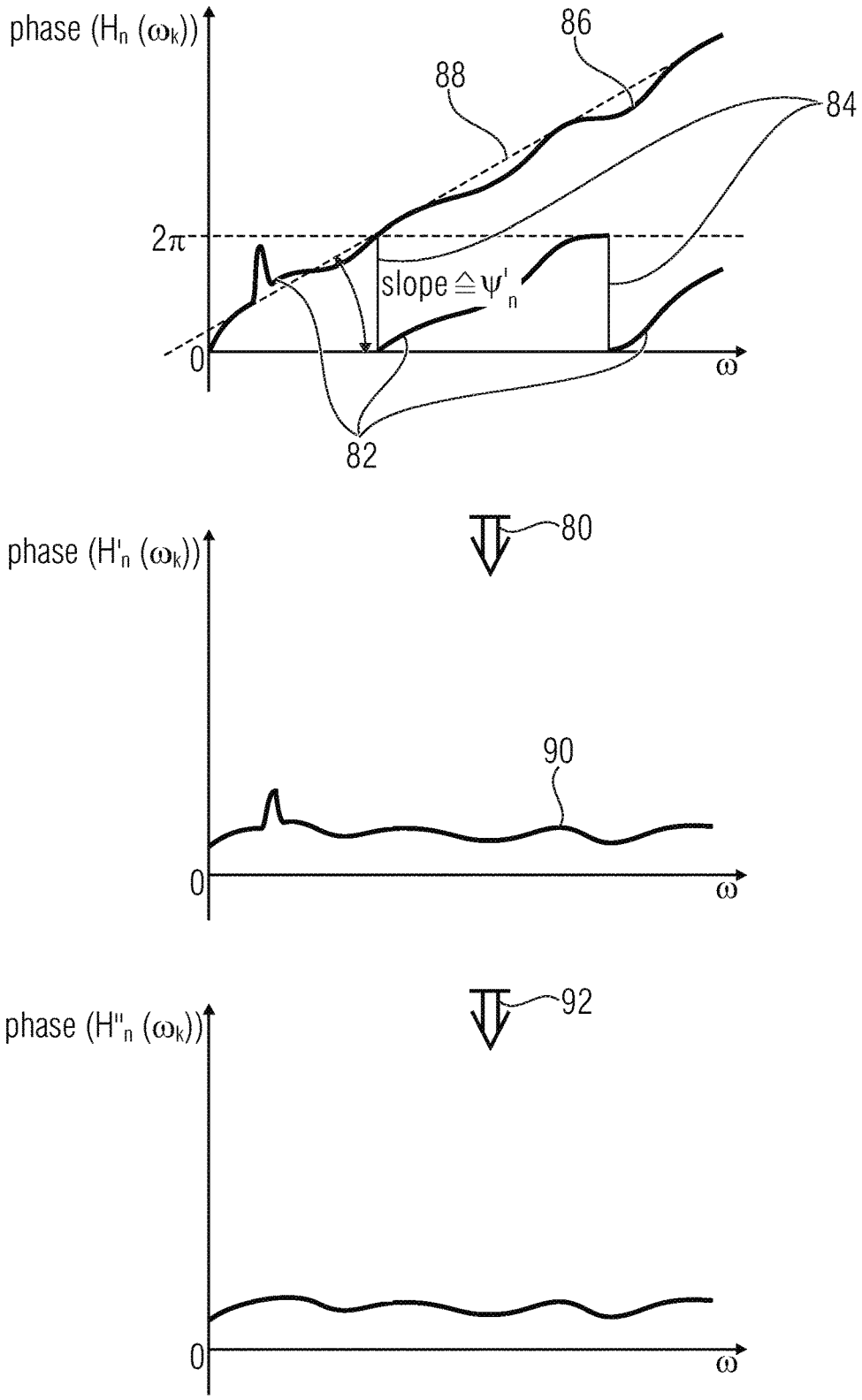
FIG. 5 schematically illustrates how, in accordance with an embodiment, the modification means in FIG. 3 which is arranged between the two calculation means renders the optimization target more suitable for time-domain optimization performed within the second calculation means.

FIG. 5 once again illustrates the mode of operation of the delay adaptation module 80 of the modification means 48. As was said above, the starting point is the set of target frequency responses 78 that are possibly to be modified, i.e. $H_n(\omega_k)$. FIG. 5 shows the phase response 82 of $H_n(\omega_k)$ by way of illustration. Said phase response exhibits phase jumps 84 by way of example. The phase response adjusted by $2\pi$ phase jumps is shown at 86 and may be approximated by a linear function 88, e.g. by a least squares fit, the linear proportion 88 having a slope which corresponds to a frequency-independent delay $\psi'_n$. Modification of the target frequency response 78 by the module 80 now provides for this linear proportion 88 to be eliminated or reduced, i.e. the phase response adjusted by $2\pi$ phase jumps is leveled and/or straightened, FIG. 5 showing the phase response of the target frequency responses $H'_n(\omega_k)$ thus modified at 90. The delays $\psi'_n$ are earmarked and stored.

A further module of the modification means 48 is the optionally existent frequency domain smoothing module 92. The following can be said about the frequency domain smoothing by the module 92. The frequency responses 78, or $H'_n(\omega_k)$, generated by the optimization-based filter design, of the driving filters n typically comprise intense fluctuations in magnitude and phase. Such design definitions are difficult to implement in an FIR filter design and/or involve a very high FIR filter order and/or FIR length of the beam-forming filters. Even though in the latter case, a good match may be achieved with the defined interfaces, intense overshoot phenomena frequently occur between the nodes $\omega_k$, said overshoot phenomena degrading the frequency response of the resulting beamformer. Also, in terms of psychoacoustic considerations it is often not useful to map such narrowband fluctuations. Therefore, the desired frequency responses 78 of the driving filters are subjected to a smoothing algorithm. The latter is performed, for example, on the basis of psychoacoustic considerations, with a frequency-dependent window width of, e.g., ⅓ octave or ⅙ octave [HN00]. Since the frequency responses are complex-valued, the smoothing is performed separately for the magnitude and the phase, for example, i.e. smoothing is separate for the magnitude transfer function (more specifically, of the zero-phase frequency response (cf., e.g., [Sar93, SI07])) and the continuous (unwrapped) phase [PF04]. It would be possible for the magnitude and the phase to be generated from the complex frequency response $H_n(\omega_k)$, or $H'_n(\omega_k)$, by a phase-unwrapping algorithm within the module 92 and to be independently smoothed by convolution with a frequency-dependent smoothing filter, also referred to as a "window". Said phase unwrapping within the module 92 may possibly be dispensed with if the module 80 is present since said phase unwrapping was already performed within module 80. Subsequently, both smoothed parts, i.e. the magnitude and the phase, are joined to form the smoothed complex frequency response, to form $H''_n(\omega_k)$, as it were. Alternatively, the separation, obtained within the module 80, of the frequency response into the zero-phase component and the continuous phase might also be smoothed directly within the module 90 and be subsequently combined. FIG. 5 indicates the combination of the application of modules 80 and 92.

Due to the optimization performed within the calculation means 46, FIR filter coefficients $h_{BFF_n}(i)$ wherein i=1 . . . I, are determined such that the target frequency responses of the beam-forming filters are approximated, e.g. $H''_n(\omega_k)$ in the case of applying both modification modules 80 and 92. Details on this will be addressed below. However, as was already mentioned, this may involve utilizing optimization methods for linear, square or, more generally, convex optimization problems. This optimization problem may be provided with secondary conditions relating to, e.g., the shape of the transfer function of the beam-forming filters, i.e. a secondary condition relating to the transfer function and/or the frequency domain of the beam-forming filters, whereas the optimization performed within the calculation means 46 otherwise concerns, as optimization variables, the FIR filter coefficients of the beam-forming filters which correspond to the impulse response of the beam-forming filters.

Figure 6:
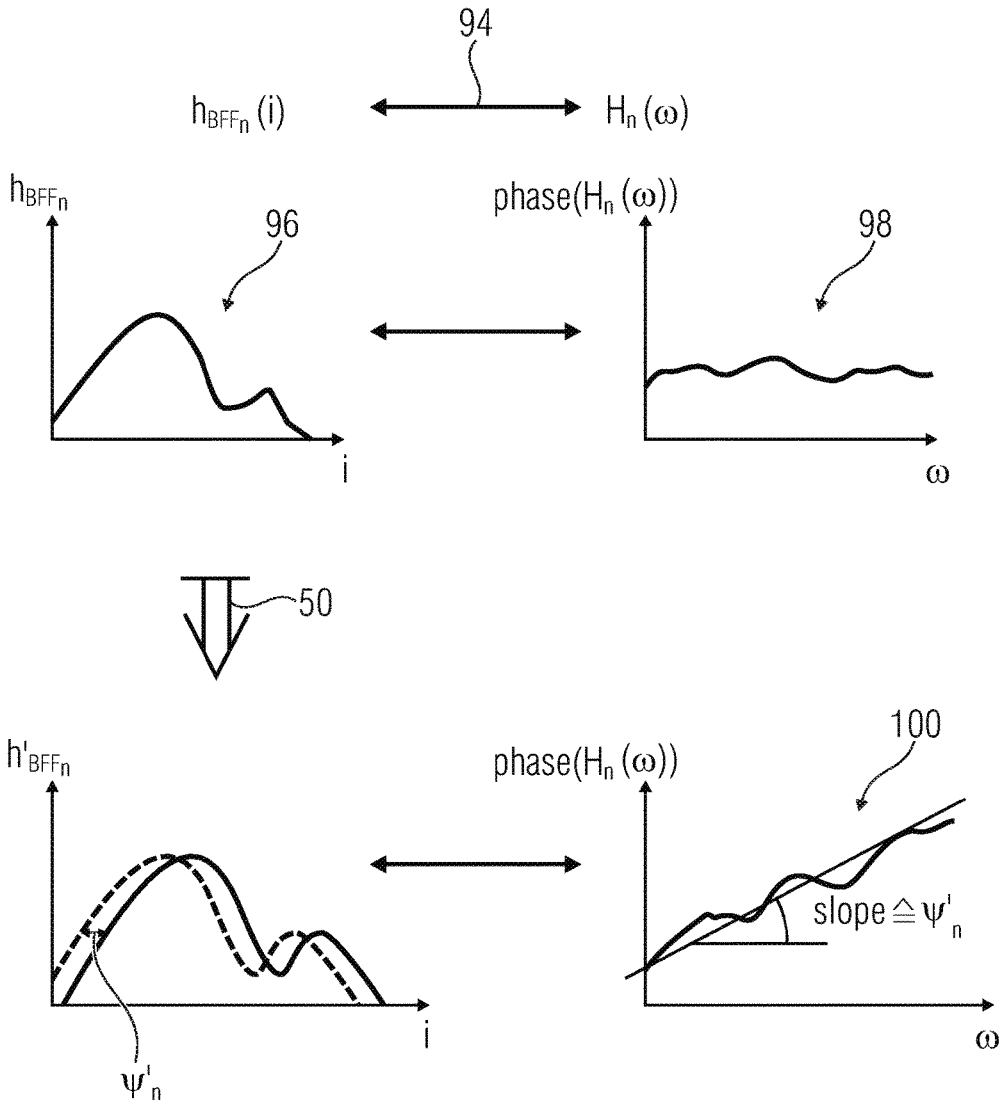
FIG. 6 schematically illustrates how, in accordance with an embodiment, the delays removed within the delay adaptation module of FIG. 3 by means of phase leveling may be re-integrated into the calculated FIR filter coefficients.

For completeness' sake, however, the significance of the modification means 50 will be addressed before describing the optimization performed within the calculation means 46 in more detail. Specifically, said modification means 50 is responsible for possibly "re-integrating" the modification performed by the module 80, i.e. the leveling of the phase response of the target frequency responses of the beam-forming filters into the FIR filter coefficients obtained by the optimization performed within the calculation means 46 in that it performs some kind of a delay recombination, such as the insertion of zeros which will be described in detail once again below and according to which zeros are placed before the FIR filter coefficients. This will be described below. By way of example, FIG. 6 shows by means of a double arrow that the FIR filter coefficients $h_{BFF_n}$ obtained by the optimization performed within the calculation means 46 describe, beam-forming filter by beam-forming filter, the impulse response of the respective beam-forming filter n and merge into, or correspond to, the transfer function $H_n(\omega)$ of the respective beam-forming filter via an FFT, or Fourier transformation. By way of example, FIG. 6 shows the impulse response at 96, and it shows the phase response, adjusted by $2\pi$ phase jumps, of the transfer function at 98 by way of example. The modification means 50 now uses the phase delay value $\psi_n$, stored for the respective beam-forming filter n, by appropriately shifting the FIR filter coefficients in accordance with $h'_{BFF_n}(i)=h_{BFF_n}(i)\pm\psi'_n$; as was already mentioned, it is advantageous for this purpose to restrict the slope $\psi'_n$, which is used for the leveling in the leveling module 80, to integral multiples of the time intervals of the FIR-filter taps since in this case taking into account of the leveling on the part of the module 80 within the modification means 50 will merely correspond to a shift in the FIR filter coefficients $h_{BFF_n}$, whereas otherwise an interpolation of the FIR filter coefficients may additionally be used. For the phase response corresponding to the modified FIR-filter coefficient $h'_{BFF_n}$ this means, as indicated at 100 in FIG. 6, that the leveling is undone, as it were.

As an alternative to the approach of FIG. 6, within the modification means 50, each beam-forming filter n might be defined not only by the beamforming FIR filter coefficients $h_{BFF_n}$ but also by the frequency-independent delay $\psi'_n$; it would be possible for the latter to be taken into account, in beam-forming filters of FIGS. 1 and 2, by a simple delay element connected in series with the FIR filter.

It is typically not possible to perform the frequency domain design, or the frequency domain optimization, 56 across the entire frequency domain of the time-discrete filter, i.e. of the FIR filter of the beam-forming filters, namely from f=0 Hz to $$f = \frac{f_s}{2}$$

with $f_s$ as the sampling frequency. For very low frequencies, in particular also for f=0 Hz, i.e. for the direct component, a firm definition of the emission behavior is not useful, specifically when modulating real transducers. Likewise, no useful definitions are typically possible for very high frequencies, e.g. relative to the spatial aliasing frequency of the array: 1) the formation of pronounced side lobes cannot be prevented by a corresponding desired characteristic. 2) The width of the beam of the desired emission direction decreases as the frequency increases. Thus, it is not possible, or it is possible only with a large specification expenditure, to make useful, accomplishable definitions regarding the widths of the beams within these frequency domains.

The statements made directly above relate to the frequency domain optimization 56 but also allow conclusions to be drawn in terms of the time domain optimization performed within the time calculation means 46. Generally, the optimization process performed within the calculation means 46, i.e. the optimization-based design of FIR filters, allows introducing frequency domains, or frequency sections, for which no definitions are made, i.e. for which there is no desired frequency response, or target frequency response, i.e. for which no optimization target is established. Such areas may be referred to as transition bands or don't care bands. However, for the beamforming applications considered, it turns out that already very narrow frequency domains without any design specification or without any optimization target will lead to uncontrolled behavior of the designed FIR filters during optimization of the second calculation means 46, e.g. they will lead to an extremely high magnitude and to fluctuations of the beam-forming filter frequency response within said frequency sections.

For this reason, FIG. 3 presents the optional possibility according to which restrictions 42 are performed in terms of the defined optimization target with regard to the frequency response within said frequency sections. As is indicated by the dashed line in FIG. 3 and as was set forth in the paragraph preceding the above paragraph, the frequency sections may be selected as a function of characteristics of the transducers. The optimization problem to be solved by the calculation means 46 takes into account the frequency restriction 42, for example, in that a maximum magnitude is indicated as a secondary condition for the convex optimization problem:

$$\ldots \text{ on the secondary condition that } |H(\omega)| \le |\hat{H}(\omega)| \quad \forall \omega \in X, \tag{1}$$

wherein X is a discretized representation of the transition, or don't care, bands, i.e. of those frequency sections for which no optimization target is to be present in the optimization performed within the second calculation means 46, and $|\hat{H}(\omega)|$ designates the maximally allowable magnitude of the frequency response at the frequency $\omega$ within the transition bands X.

An alternative to using frequency restrictions 42, or restrictions for high and/or low frequencies, consists in using a hybrid design approach, which will be described below.

It is the goal of the optimization performed within the second calculation means 46 to generate FIR filters, with which filtering of the source signals, i.e. of the loudspeaker signals in the event of a loudspeaker array as shown in FIG. 1, and of the microphone output signals in the event of a microphone array as shown in FIG. 2, may be performed, from the frequency responses which are obtained as a result of the frequency domain design for the beamformers and which were referred to as $H_n(\omega_k)$ or $H'_n(\omega_k)$ or $H''_n(\omega_k)$ above and which will be referred to below as a desired frequency response with the variable name of $\hat{H}(\omega)$. For this purpose, a mathematical optimization method is used which may be a method of convex optimization, for example. By means of said method, the frequency response $H(\omega)$ of the designed FIR filter h(i) is determined such that $\hat{H}(\omega)$ is approximated as well as possible, i.e. that the error regarding a selectable standard p becomes minimal. Generally, the optimization problem may be presented in the following form:

$$\underset{h(i),,0\le i\le I}{\text{minimize}} \left\| H(\omega) - \hat{H}(\omega) \right\|_p \tag{2}$$

on the secondary condition that <secondary condition(s)>

The supplement <secondary condition(s)> is optional. Secondary conditions need not but may exist, as was already described above by way of example with regard to the high-frequency restrictions. One single secondary condition is also possible. Generally, said secondary conditions represent a multitude of possible secondary conditions which may relate to, but need not exclusively relate to, the frequency response or the coefficients of the FIR filter. The frequency variable ω, here used as a normalized angular frequency $\omega=2\pi f/f_s$, is typically discretized. Thus, both the optimization problem of equation (2) and the secondary conditions may typically be presented in a matrix form.

The target frequency responses for the time domain optimization performed within the second calculation means 46, which result within the context of the frequency domain optimization 56 (and/or of the modification 80 and/or 92) are generally complex-valued and comprise a non-trivial, in particular neither linear nor minimal-phase, frequency response. Thus, the optimization problem of the above-mentioned equation (2) corresponds to a filter design problem for FIR filters having arbitrary phase characteristics. A multitude of methods have been described on this in literature, such as in [PR95, KM95; KM99].

In the implementation of the design algorithm, the delays contained within the filters $\hat{H}(\omega)$ and $\hat{H}(\omega)$, i.e. the linear term of the phase response adjusted by 2π phase jumps, exhibit particular significance. As depicted in [KM99], utilization of arbitrary phase responses results in very poorly conditioned optimization problems or degenerated solutions. This is the case particularly if the standard formulation of a causal FIR filter having the frequency response $$H(\omega) = \sum_{n=0}^{N} e^{-j\omega n}$$

is used. For this reason it would be possible, as suggested in [KM99], to perform the design on the basis of a non-causal FIR filter having the transfer function $$H_{nc}(\omega) = \sum_{n=0}^{N} h[n]G(n, \omega) \text{ with } G(n, \omega) = e^{-j\omega(n-\frac{N}{2})}. \tag{4a}$$

The causal (3) and the non-causal (4a) filters differ in terms of the pure delay term, namely $$H(e^{j\omega}) = e^{-j\frac{N}{2}\omega} H_{nc}(\omega). \tag{5}$$

When using the non-causal frequency response, the desired function $\hat{H}(\omega)$ should be adapted such that the linear proportion of the phase is as close to 0 as possible. This is effectively implemented by the modifications 80 and 50.

Once the impulse responses of the FIR filters, i.e. h(i), were determined during the optimization performed within the second calculation means 46, the modification means 50 optionally re-integrates the previously compensated-for delay components into the driving filters. According to an alternative embodiment, integration of the delays $\psi'_n$ into the filters n is circumvented in that the pure delays $\psi'_n$ are applied, during the runtime of the beamforming application, to the input or output signals of the control filters by means of suitable signal processing means such as digital delay lines, for example. In this case it is merely to be ensured that the impulse responses of the obtained FIR filters are causal, i.e. that the indices of the impulse responses start at 0. Such a modification involves no active calculation operations at the runtime but corresponds merely to introducing a constant implementation-induced delay for all driving filters n. Care should be taken to ensure that this delay is constant for all driving filters of a beamformer. For separate application of the delay it may be advantageous to select those delays that were extracted in the delay adaptation 80 as multiples of the sampling period. In this case, specifically, the delay lines may be used for integral delays, as was already described with regard to FIG. 6, which are no filtering operations but may involve merely indexed access to the signal while not causing any distortions. Alternatively, it is also possible to map arbitrary delay values. However, this may use delay lines with access to arbitrary delays (fractional delay lines), which may cause distortions, involve calculating power and possibly result in additional latency or delay.

In the context of the high-frequency restriction 42, it was already set forth that an optimization equally relating to all frequencies is not always useful. The same applies to the frequency domain optimization 56. It was already hinted above that a hybrid design approach might also be used in the frequency domain optimization 56. According to said approach, an optimization-based approach to obtaining the frequency domain driving functions $H_m(\omega_k)$ as has been described so far is combined with a design corresponding to the DSB design as is calculated within module 54, the DSB design approach being used for the high frequencies. The goal here is to reduce the filter order that may be used while improving robustness at the same time. In this context, use is made of the fact that for high frequencies, the emission characteristic of the transducer array can no longer be fully controlled due to spatial aliasing. This is why a DSB design approach is used for frequencies above a specified fundamental frequency, e.g. a frequency that is relatively close to the spatial aliasing frequency of the transducer array. For this purpose, the frequency domain specification of the entire filter is combined from two parts: the frequency responses, obtained by means of optimization, up to the fundamental frequency, and the frequency responses, corresponding to those of the DSB, for the frequencies thereabove. The combination of both methods is effected by subsequent smoothing, which was already described above, and by the optimization-based FIR design. A critical step here is to match the signal delay time (delays) of both design approaches. For example, it is possible to determine, by means of a least squares fit, a delay offset for the DSB such that the delay jumps of the individual driving filters are minimized within the root mean square.

In various exemplary designs, the hybrid design approach enables more robust emission within the high-frequency domain, which is characterized by less erratic fluctuations of the behavior without any appreciable losses in performance and with the directional efficiency within the low-frequency domain being partly improved at the same time and, additionally, with a constant filter order. As a reason for this one may assume that the degrees of freedom provided by a specific filter order may be better used, in the hybrid design approach, for those frequency domains wherein it is possible to influence the characteristic, whereas fewer resources are employed for high frequencies wherein there are tough restrictions for the suppression of undesired emission due to spatial aliasing.

Figure 7:
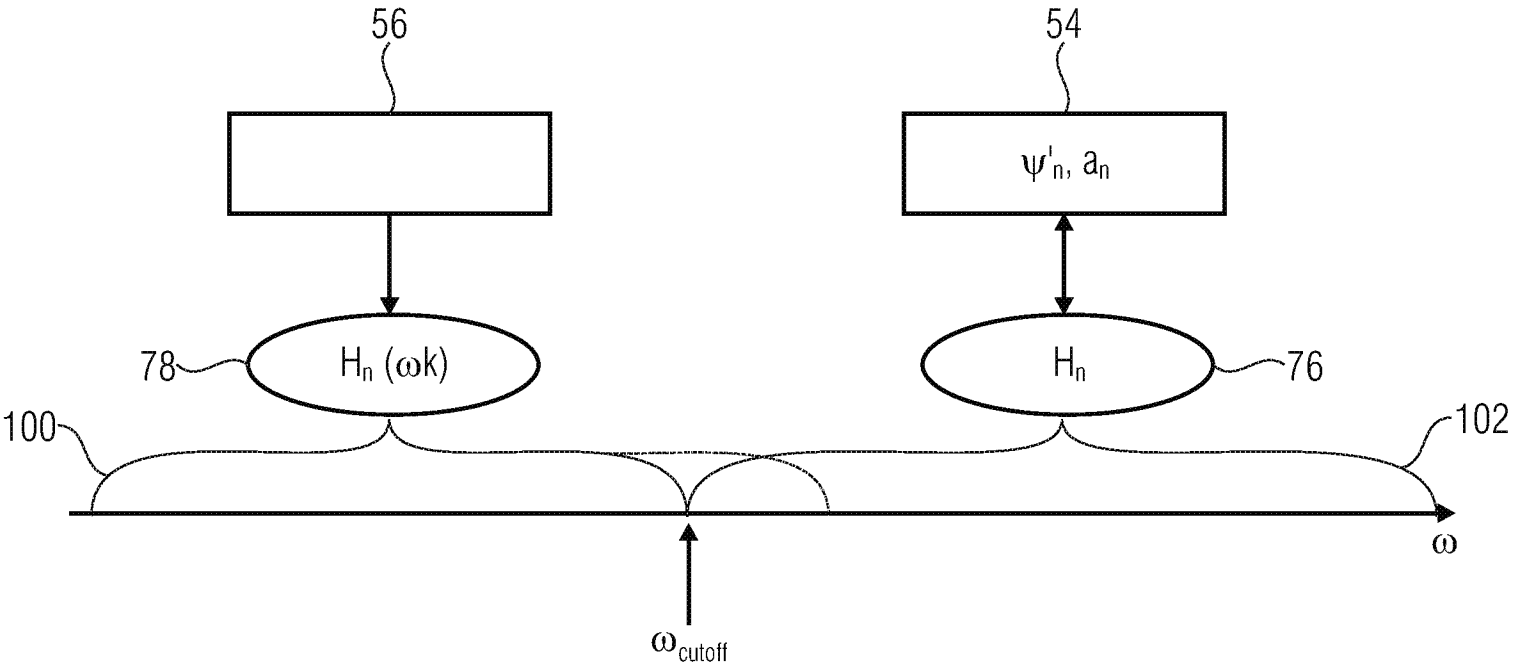
FIG. 7 schematically shows how, in accordance with a hybrid approach for performing the target frequency response calculation in the first calculation means of FIG. 3, the target frequency response is composed of an optimized component in a low-frequency section and a DSB transfer function in a high-frequency section.

FIG. 7 once again illustrates the hybrid design approach: the transfer function to be used for time-domain optimization performed within the second calculation means 46 is composed of the transfer function obtained in accordance with the frequency domain optimization 56, as far as a section of lower audio frequencies 100 is concerned; the transfer functions $H_n$, which correspond to the frequency-independent pairs of values $\psi_n a_n$, are used in the section of higher audio frequencies 102. The section 100 and the section 102 may border on each other at a cut-off frequency $\omega_{border}$, which corresponds to the spatial cut-off aliasing frequency of the transducer array, for example, or deviates by less than 10% from the latter. It would also be possible, as indicated by dashed dots, for the low-frequency section and the high-frequency section 100 and 102 to overlap each other. For example, if the section 100 extends over $[\omega_{N,b}, \omega_{N,e}]$, and the section 102 extends over $[\omega_{H,b}, \omega_{H,e}]$, then $\omega_{N,b}<\omega_{H,b} \wedge \omega_{N,e}<\omega_{H,e}$ shall apply, for example, wherein possibly $\omega_{N,b}=0$ and/or $\omega_{H,b}\leq\omega_{N,e}$ or even $\omega_{H,b}=\omega_{N,e}$ and/or $0.9\cdot\omega_{border}<\omega_{H,b},\omega_{N,e}<1.1\cdot\omega_{border}$ applies. In the overlap area of both sections, the time-domain optimization transfer function which is eventually to be used might be obtained, for example, by averaging between both transfer functions (DSB design and optimization result of 56).

In summary, therefore, the above embodiments described a possibility of providing a design of robust FIR filters for beam-forming applications. FIR filters with arbitrary phase responses may be generated from complex-valued frequency responses of the individual beam-forming filters. The specific value of the above embodiments consists in that robustness properties of the beamformers may be obtained.

Particular advantages of the above embodiments consist in that, for example, robust FIR filters may also be obtained for complex beam-forming problems, such as even beyond the aliasing frequency of the transducer array in case of broadband operation, or in case of complex behavior of the transducers, such as a limited level at low frequencies, for example. A further advantage consists in that the frequency raster of the frequency response specification, i.e., in the frequency domain optimization 56, and the filter order of the FIR filters of the beam-forming filters may be selected independently of one another. In addition, a multitude of design specifications for beamformers and the filters are possible: secondary conditions such as level limits, behavior of the filter in regions for which no beam-forming frequency response exists, etc., may be integrated in a simple manner.

The present invention may be employed in a multitude of beam-forming applications, such as in loudspeaker arrays for spatially selective acoustic irradiation, for generating "quiet zones" or for reproducing surround material via loudspeaker lines (soundbars). Likewise, the above embodiments may also be used by microphone arrays so as to receive sound in a directionally selective manner.

Possibly, beam-forming applications for electromagnetic waves such as mobile radio antennae or radar antennae, for example, would also be feasible. However, the bandwidths that may be used there are clearly smaller than those employed for audio applications, so that implementation as FIR filters and/or the need for a design approach for broadband filters is difficult to estimate here.

Even though some aspects have been described within the context of a device, it is understood that said aspects also represent a description of the corresponding method, so that a block or a structural component of a device is also to be understood as a corresponding method step or as a feature of a method step. By analogy therewith, aspects that have been described in connection with or as a method step also represent a description of a corresponding block or detail or feature of a corresponding device. Some or all of the method steps may be performed by a hardware device (or while using a hardware device), such as a microprocessor, a programmable computer or an electronic circuit. In some embodiments, some or several of the most important method steps may be performed by such a device.

The inventive set of FIR filter coefficients 32 for the beam-forming filters may be stored on a digital storage medium or may be transmitted on a transmission medium such as a wireless transmission medium or a wired transmission medium, for example the internet.

Depending on specific implementation requirements, embodiments of the invention may be implemented in hardware or in software. Implementation may be effected while using a digital storage medium, for example a floppy disc, a DVD, a Blu-ray disc, a CD, a ROM, a PROM, an EPROM, an EEPROM or a FLASH memory, a hard disc or any other magnetic or optical memory which has electronically readable control signals stored thereon which may cooperate, or cooperate, with a programmable computer system such that the respective method is performed. This is why the digital storage medium may be computer-readable.

Some embodiments in accordance with the invention thus include a data carrier which comprises electronically readable control signals that are capable of cooperating with a programmable computer system such that any of the methods described herein is performed.

Generally, embodiments of the present invention may be implemented as a computer program product having a program code, the program code being effective to perform any of the methods when the computer program product runs on a computer.

The program code may also be stored on a machine-readable carrier, for example.

Other embodiments include the computer program for performing any of the methods described herein, said computer program being stored on a machine-readable carrier.

In other words, an embodiment of the inventive method thus is a computer program which has a program code for performing any of the methods described herein, when the computer program runs on a computer.

A further embodiment of the inventive methods thus is a data carrier (or a digital storage medium or a computer-readable medium) on which the computer program for performing any of the methods described herein is recorded.

A further embodiment of the inventive method thus is a data stream or a sequence of signals representing the computer program for performing any of the methods described herein. The data stream or the sequence of signals may be configured, for example, to be transferred via a data communication link, for example via the internet.

A further embodiment includes a processing means, for example a computer or a programmable logic device, configured or adapted to perform any of the methods described herein.

A further embodiment includes a computer on which the computer program for performing any of the methods described herein is installed.

A further embodiment in accordance with the invention includes a device or a system configured to transmit a computer program for performing at least one of the methods described herein to a receiver. The transmission may be electronic or optical, for example. The receiver may be a computer, a mobile device, a memory device or a similar device, for example. The device or the system may include a file server for transmitting the computer program to the receiver, for example.

In some embodiments, a programmable logic device (for example a field-programmable gate array, an FPGA) may be used for performing some or all of the functionalities of the methods described herein. In some embodiments, a field-programmable gate array may cooperate with a microprocessor to perform any of the methods described herein. Generally, the methods are performed, in some embodiments, by any hardware device. Said hardware device may be any universally applicable hardware such as a computer processor (CPU), or may be a hardware specific to the method, such as an ASIC.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

LITERATURE

[ACL93] Ashraf S. Alkhairy, Kevin G. Christian, and Jae S. Lim. Design and characterization of optimal FIR filters with arbitrary phase. IEEE Transactions on Signal Processing, 41 (2):559-572, February 1993.

[BW01] Michael Brandstein and Darren Ward, editors. Microphone Arrays: Signal Processing Techniques and Applications. Springer 2001.

[HM00] Panagiotis D. Hatziantoniou and John N. Mourjopoulos. Generalized fractional-octave smoothing of audio and acoustic responses. Journal of the Audio Engineering Society, 48(4): 259-280, April 2000

[KM95] Lina J. Karam and James H. McClellan. Complex Chebyshev approximation for FIR filter design. IEEE Transactions on Circuits and Systems II: Analog and Digital Signal Processing, 42(3):207-216, March 1995.

[KM99] Lina J. Karam and James H. McClellan. Chebyshev digital FIR filter design. Signal processing, 79(1):17-36, July 1999

[Lyo11] Richard G. Lyons. Understanding Digital Signal Processing ($3^{rd}$ Edition) (Hardcover), Pearson, Upper Saddle River, N.J., $3^{rd}$ edition, 2011.

[MK07] Edwin Mabande and Walter Kellermann. Towards superdirective beamforming with loudspeaker arrays. In Conf. Rec. International Congress on Acoustics, 2007.

[MSK09] Edwin Mabande, Adrian Schad, and Walter Kellermann. Design of robust superdirective beamformers as convex optimization problem. In IEEE International Conference on Acoustics, Speech and Signal Processing (ICASSP 2009), pages 77-80, April 2009.

[MSK11] Edwin Mabande, Adrian Schad, and Walter Kellermann. A time-domain implementation of data-independent robust broadband beamfomers with low filter order. In Workshop on Hands-free Speech Communication and Microphone Arrays (HSCMA), pages 81-85, Edinburgh, UK, May 2011.

[PF04] Jörg Panzer and Lampos Ferekidis. The use of continuous phase for interpolation, smoothing and forming mean values of complex frequency response curves. In $116^{th}$ AES Convention, Berlin, Germany, May 2004.

[PR95] Alexander W. Potchinkov and R Reemtsen. The design of FIR filters in the complex plane by convex optimization. Signal Processing, 46(2):127-146, October 1995.

[Sar93] Tapio Saramäki. Finite impulse response filter design. In S. K. Mitra and J. F. Kaiser editors, Handbook for Digital Signal Processing, chapter 4, pages 155-278. John Wiley & Sons, Inc., 1993.

[S107] Julius O. Smith III. Introduction to Digital Filters with Audio Applications, W3K Publishing, 2007 http://w3k.org/books/http://www.w3k.org/books/.

[Smi11] Julius O. Smith. Spectral Audio Signal Processing. W3K Publishing 2011. [online] http://ccrma.stanford.edu~jos/sasp.

The invention claimed is:

1. A device for calculating FIR filter coefficients for beam-forming filters of a transducer array, comprising:

a first calculator for receiving a desired directional selectivity and transducer data describing the transducer array as first inputs and calculating from the first inputs frequency domain filter weights of the beam-forming filters for a predetermined frequency raster so as to acquire target frequency responses for the beam-forming filters, so that application of the beam-forming filters to the transducer array approximates a desired directional selectivity;

a second calculator;

a target frequency response modifier connected between the first calculator and the second calculator so as to modify the target frequency responses of the beam-forming filters as acquired by the first calculator, said modification comprising for each beam-forming filter, leveling of a phase response, adjusted by $2\pi$ phase jumps, of the target frequency response of the respective beam-forming filter by removing a linear phase function portion, and storing a delay for the respective beam-forming filter, said delay corresponding to a slope of the linear phase function portion, wherein the second calculator is configured to receive the target frequency responses in a form modified by the target frequency response modifier as second inputs and calculate, from the second inputs, the FIR filter coefficients for the beam-forming filters so that frequency responses of the beam-forming filters approximate the target frequency responses in the form modified by the target frequency response modifier.

2. The device as claimed in claim 1, wherein the first calculator is configured to perform the calculation by solving a first optimization problem according to which a deviation between a directional selectivity of the array, as results from the frequency domain filter weights, and the desired directional selectivity is minimized.

3. The device as claimed in claim 2, wherein the first calculator is configured such that the first optimization problem is a convex optimization problem.

4. A device for calculating FIR filter coefficients for beam-forming filters of a transducer array, comprising:

a first calculator for calculating frequency domain filter weights of the beam-forming filters for a predetermined frequency raster so as to acquire target frequency responses for the beam-forming filters, so that application of the beam-forming filters to the transducer array approximates a desired directional selectivity; and a second calculator for calculating the FIR filter coefficients for the beam-forming filters so that frequency responses of the beam-forming filters approximate the target frequency responses;

further comprising a target frequency response modifier connected between the first calculator and the second calculator so as to modify the target frequency responses of the beam-forming filters as acquired by the first calculator, so that the second calculator calculates the FIR filter coefficients for the beam-forming filters in such a manner that the frequency responses of the beam-forming filters approximate the target frequency responses in a form modified by the target frequency response modifier, said modification comprising frequency domain smoothing and/or for each beam-forming filter, leveling of a phase response, adjusted by $2\pi$ phase jumps, of the target frequency response of the respective beam-forming filter by removing a linear phase function portion, and storing a delay for the respective beam-forming filter, said delay corresponding to a slope of the linear phase function portion, wherein the first calculator is configured to perform the calculation by solving a first optimization problem according to which a deviation between a directional selectivity of the array, as results from the frequency domain filter weights, and the desired directional selectivity is minimized, wherein the first calculator is configured to combine the calculation within a first range of relatively low audio frequencies by solving the first optimization problem so as to acquire low-frequency domain target frequency responses for the beam-forming filters, and within a second range of relatively high audio frequencies by calculating global-frequency delays and amplitude weights for the array as a function of the desired directional selectivity, and to subsequently combine the low-frequency domain target frequency responses with high-frequency domain target frequency responses which correspond to global-frequency delays and amplitude weights.

5. The device as claimed in claim 1, said device further comprising an FIR filter coefficient modifier configured to subject the FIR filter coefficients as are calculated by the second calculator to a time-domain shift corresponding to the stored delay for the respective beam-forming filter.

6. The device as claimed in claim 1, wherein the second calculator is configured to perform the calculation by solving a second optimization problem according to which a deviation between the frequency responses of the beam-forming filters corresponding to the FIR filter coefficients and the target frequency responses is minimized.

7. The device as claimed in claim 6, wherein the second calculator is configured such that the second optimization problem is a convex optimization problem.

8. The device as claimed in claim 6, wherein the second calculator is configured such that the second optimization problem defines the deviation in a frequency-selective manner, or defines frequency-dependent tolerance thresholds for the deviation.

9. The device as claimed in claim 6, wherein the second calculator is configured such that as a secondary condition, the second optimization problem comprises, in at least one frequency section wherein the deviation is not minimized, a restriction of the magnitude of the frequency responses of the beam-forming filters which correspond to the FIR filter coefficients.

10. The device as claimed in claim 1, wherein a frequency resolution of the beam-forming filters as is defined by the FIR filter coefficients differs from a frequency resolution of the frequency raster for which the frequency domain filter weights of the beam-forming filters are calculated.

11. A method of calculating FIR filter coefficients for beam-forming filters of a transducer array comprising:

subjecting a desired directional selectivity and transducer data describing the transducer array as first inputs to a first calculation which calculates from the first inputs frequency domain filter weights of the beam-forming filters for a predetermined frequency raster so as to acquire target frequency responses for the beam-forming filters, so that application of the beam-forming filters to the transducer array approximates a desired directional selectivity; and modifying the target frequency responses of the beam-forming filters, said modification comprising for each beam-forming filter, leveling of a phase response, adjusted by $2\pi$ phase jumps, of the target frequency response of the respective beam-forming filter by removing a linear phase function portion, and storing a delay for the respective beam-forming filter, said delay corresponding to a slope of the linear phase function portion;

and subjecting the target frequency responses in a form modified by the target frequency response modifier to a second calculation which calculates from the second inputs the FIR filter coefficients for the beam-forming filters so that frequency responses of the beam-forming filters approximate the target frequency responses in the form modified by the target frequency response modifier.

12. A non-transitory digital storage medium having a computer program stored thereon to perform the method of calculating FIR filter coefficients for beam-forming filters of a transducer array, said method comprising:

subjecting a desired directional selectivity and transducer data describing the transducer array as first inputs to a first calculation which calculates from the first inputs frequency domain filter weights of the beam-forming filters for a predetermined frequency raster so as to acquire target frequency responses for the beam-forming filters, so that application of the beam-forming filters to the transducer array approximates a desired directional selectivity; and modifying the target frequency responses of the beam-forming filters, said modification comprising for each beam-forming filter, leveling of a phase response, adjusted by $2\pi$ phase jumps, of the target frequency response of the respective beam-forming filter by removing a linear phase function portion, and storing a delay for the respective beam-forming filter, said delay corresponding to a slope of the linear phase function portion;

and subjecting the target frequency responses in a form modified by the target frequency response modifier to a second calculation which calculates from the second inputs the FIR filter coefficients for the beam-forming filters so that frequency responses of the beam-forming filters approximate the target frequency responses in a form modified by the target frequency response modifier when said computer program is run by a computer.

13. A device for calculating FIR filter coefficients for beam-forming filters of a transducer array, comprising:

a first calculator for calculating frequency domain filter weights of the beam-forming filters for a predetermined frequency raster so as to acquire target frequency responses for the beam-forming filters, so that application of the beam-forming filters to the transducer array approximates a desired directional selectivity; and a second calculator for calculating the FIR filter coefficients for the beam-forming filters so that frequency responses of the beam-forming filters approximate the target frequency responses;

further comprising a target frequency response modifier connected between the first calculator and the second calculator so as to modify the target frequency responses of the beam-forming filters as acquired by the first calculator, so that the second calculator calculates the FIR filter coefficients for the beam-forming filters in such a manner that the frequency responses of the beam-forming filters approximate the target frequency responses in a form modified by the target frequency response modifier, said modification comprising for each beam-forming filter, leveling of a phase response, adjusted by $2\pi$ phase jumps, of the target frequency response of the respective beam-forming filter by removing a linear phase function portion, and storing a delay for the respective beam-forming filter, said delay corresponding to a slope of the linear phase function portion.

14. A method of calculating FIR filter coefficients for beam-forming filters of a transducer array comprising:

calculating frequency domain filter weights of the beam-forming filters for a predetermined frequency raster so as to acquire target frequency responses for the beam-forming filters, so that application of the beam-forming filters to the transducer array approximates a desired directional selectivity; and modifying the target frequency responses of the beam-forming filters, said modification comprising for each beam-forming filter, leveling of a phase response, adjusted by $2\pi$ phase jumps, of the target frequency response of the respective beam-forming filter by removing a linear phase function portion, and storing a delay for the respective beam-forming filter, said delay corresponding to a slope of the linear phase function portion;

and calculating the FIR filter coefficients for the beam-forming filters so that frequency responses of the beam-forming filters approximate the target frequency responses in a form modified by the target frequency response modifier.

* * * * *